US008646533B2

(12) United States Patent
Nguy et al.

(10) Patent No.: US 8,646,533 B2
(45) Date of Patent: Feb. 11, 2014

(54) MECHANICAL SLIDING SLEEVE

(75) Inventors: Vi (Jim) Nguy, Calgary (CA); Nathan Kathol, Chestermere (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 376 days.

(21) Appl. No.: 13/130,269

(22) PCT Filed: Feb. 9, 2010

(86) PCT No.: PCT/IB2010/050594
§ 371 (c)(1),
(2), (4) Date: May 19, 2011

(87) PCT Pub. No.: WO2010/089728
PCT Pub. Date: Aug. 12, 2010

(65) Prior Publication Data

US 2011/0259595 A1 Oct. 27, 2011

(30) Foreign Application Priority Data

Feb. 9, 2009 (CA) ..... 2653254

(51) Int. Cl.
*E21B 34/14* (2006.01)

(52) U.S. Cl.
USPC ..... 166/332.1; 166/332.4; 166/373; 166/386; 251/347

(58) Field of Classification Search
USPC ..... 166/332.1, 332.4, 334.1, 334.3, 373, 166/386; 251/319, 347
See application file for complete search history.

(56) References Cited

U.S. PATENT DOCUMENTS

| | | | | |
|---|---|---|---|---|
| 3,378,068 | A * | 4/1968 | Page, Jr. | 166/373 |
| 4,151,880 | A * | 5/1979 | Vann | 166/373 |
| 4,162,078 | A | 7/1979 | Cox | |
| 5,558,153 | A * | 9/1996 | Holcombe et al. | 166/373 |
| 6,286,594 | B1 | 9/2001 | French | |
| 7,032,675 | B2 | 4/2006 | Steele | |
| 7,363,981 | B2 | 4/2008 | Coon | |
| 8,267,178 | B1 * | 9/2012 | Sommers et al. | 166/334.4 |
| 2003/0056951 | A1 | 3/2003 | Kaszuba | |
| 2008/0217021 | A1 | 9/2008 | Lembcke | |

FOREIGN PATENT DOCUMENTS

| | | |
|---|---|---|
| EP | 1760253 | 7/2008 |
| WO | 2007/050618 | 5/2007 |

OTHER PUBLICATIONS

Steam Shield 2000, Sealweld Corporation: Cleaners, Lubricants & Sealant, p. 11.

* cited by examiner

*Primary Examiner* — Kenneth L Thompson
(74) *Attorney, Agent, or Firm* — Daren C. Davis; Wayne I. Kanak

(57) ABSTRACT

A mechanical sliding sleeve (101) includes a sleeve housing (105) defining a fluid communication port, a first sub (103) affixed to the sleeve housing, and a second sub (107) affixed to the sleeve housing. An isolation sleeve (201) is disposed in an internal bore defined by the sleeve housing, the first sub, and the second sub, and defines a fluid communication port (113). The isolation sleeve is slidable along interfaces between the first sub, the second sub, and the sleeve housing between an open position, wherein fluid is allowed through the ports, and a closed position, wherein fluid passage through the ports is inhibited. A sealing element is operably associated with the sleeve housing, the first sub, the second sub, and the isolation sleeve to inhibit fluid flow through the ports unless the isolation sleeve is in the open position, and to seal at least a portion of the interfaces from contact with downhole fluids.

18 Claims, 15 Drawing Sheets

MECHANICAL SLIDING SLEEVE

BACKGROUND OF THE INVENTION

1. Field of the Invention

The present invention relates to a mechanical sliding sleeve for use in downhole, oilfield operations.

2. Description of Related Art

In downhole oilfield operations, it is often desirable to selectively allow fluid communication between an interior of a tubing string and an annulus defined by the tubing string and a well casing. A "sliding sleeve," which typically is made up as an integral part of a tubing string, provides such functionality. The sliding sleeve utilizes a sliding isolation sleeve to isolate fluid communication between the annulus and the interior of the tubing string. When in a "closed" configuration, the isolation sleeve is slidingly positioned to inhibit flow between the interior of the tubing string and the annulus. When in an "open" configuration, the isolation sleeve is slidingly positioned to allow flow between the interior of the tubing string and the annulus.

Such isolation sleeves are typically operated either by mechanical means or by hydraulic means. Mechanically-operated isolation sleeves are operated by running a "shifting tool" into a bore of the sliding sleeve and using the tool to physically move the isolation sleeve between the open and closed positions. Moving parts of conventional mechanically-operated isolation sleeves, however, are exposed to downhole fluids that contain debris, which can foul the moving parts. Such debris and other deposits from downhole fluids can readily form obstructions about the moving parts of sliding sleeves, sometimes encasing the sleeve in a shell, thus preventing the shifting tool from shifting the sleeve. In thermal wells, the rate and quantity at which deposits form on the sliding sleeve is greatly accelerated, as compared to non-thermal wells. Normally, extensive cleaning of such shifting sleeves is required before the sleeve can be operated. However, cleaning does not always ensure proper operation of such sleeves. Moreover, the position of a conventional mechanically-operated sliding sleeve in a tubing string is often difficult to locate when the shifting tool is lowered into the tubing string.

Hydraulically-operated isolation sleeves utilize hydraulic circuits incorporated into the sliding sleeve that route hydraulic fluid to move the isolation sleeve between the open and closed positions. Such hydraulically-operated isolation sleeves are more complex, are susceptible to hydraulic fluid leaks, and have larger annular profiles than mechanically-operated isolation sleeves. Moreover, hydraulically-operated sliding sleeves are more difficult and time consuming to install. Furthermore, a secondary method of shifting hydraulically-operated sliding sleeves is desirable in case the hydraulic system used to primarily operate the sliding sleeve fails. In some cases, providing fluid communication between the tubing string and the annulus may entail machining an opening through the sliding sleeve by, for example, milling.

There are many designs of sliding sleeves well known in the art, however, considerable shortcomings remain.

BRIEF SUMMARY OF THE INVENTION

In one aspect, a mechanical sliding sleeve is provided. The mechanical sliding sleeve includes a sleeve housing defining a fluid communication port, a first end and a second end; a first sub affixed to the first end of the sleeve housing; and a second sub affixed to the second end of the sleeve housing. The sleeve housing, the first sub, and the second sub define an internal bore. The mechanical sliding sleeve further includes an isolation sleeve disposed in the internal bore and defining a fluid communication port. The isolation sleeve is slidable along interfaces between the first sub, the second sub, and the sleeve housing between an open position, wherein the fluid communication port of the isolation sleeve is at least generally aligned with the fluid communication port of the sleeve housing, and a closed position, wherein the fluid communication port of the isolation sleeve is misaligned with the fluid communication port of the sleeve housing. The mechanical sliding sleeve further includes at least one sealing element operably associated with the sleeve housing, the first sub, the second sub, and the isolation sleeve. The at least one sealing element inhibits fluid flow through the fluid communication ports unless the isolation sleeve is in the open position and seals at least a portion of the interfaces from contact with downhole fluids.

In another aspect, the present invention provides a tubing string. The tubing string includes a production string having an upper portion and a lower portion. The tubing string further includes a mechanical sliding sleeve affixed between and in fluid communication with the upper portion of the production string and the lower portion of the production string. The mechanical sliding sleeve includes a sleeve housing defining a fluid communication port, a first end and a second end; a first sub affixed to the first end of the sleeve housing and to the upper portion of the production string; and a second sub affixed to the second end of the sleeve housing and to the lower portion of the production string. The sleeve housing, the first sub, and the second sub define an internal bore. The mechanical sliding sleeve further includes an isolation sleeve disposed in the internal bore and defining a fluid communication port. The isolation sleeve is slidable along interfaces between the first sub, the second sub, and the sleeve housing between an open position, wherein the fluid communication port of the isolation sleeve is at least generally aligned with the fluid communication port of the sleeve housing, and a closed position, wherein the fluid communication port of the isolation sleeve is misaligned with the fluid communication port of the sleeve housing. The mechanical sliding sleeve further includes at least one sealing element operably associated with the sleeve housing, the first sub, the second sub, and the isolation sleeve. The at least one sealing element inhibits fluid flow through the fluid communication ports unless the isolation sleeve is in the open position and seals at least a portion of the interfaces from contact with downhole fluids.

In yet another aspect, a well completion is provided. The well completion includes a wellhead, a production string having an upper portion affixed to the wellhead and a lower portion, and a mechanical sliding sleeve affixed between and in fluid communication with the upper portion of the production string and the lower portion of the production string. The mechanical sliding sleeve includes a sleeve housing defining a fluid communication port, a first end and a second end; a first sub affixed to the first end of the sleeve housing and to the upper portion of the production string; and a second sub affixed to the second end of the sleeve housing and to the lower portion of the production string. The sleeve housing, the first sub, and the second sub define an internal bore. The mechanical sliding sleeve further includes an isolation sleeve disposed in the internal bore and defining a fluid communication port. The isolation sleeve is slidable along interfaces between the first sub, the second sub, and the sleeve housing between an open position, wherein the fluid communication port of the isolation sleeve is at least generally aligned with the fluid communication port of the sleeve housing, and a closed position, wherein the fluid communication port of the isolation sleeve is misaligned with the fluid communication port of the sleeve housing. The mechanical sliding sleeve further includes at least one sealing element operably associated with the sleeve housing, the first sub, the second sub, and the isolation sleeve. The at least one sealing element inhibits fluid flow through the fluid communication ports unless the isolation sleeve is in the open position and seals at least a portion of the interfaces from contact with downhole fluids.

The present invention provides significant advantages, including: (1) providing a mechanical sliding sleeve having moving parts that are protected from downhole fluids and, therefore, debris contained in the downhole fluids; (2) providing a mechanical sliding sleeve having an isolation sleeve that is contained within a pressure integral volume; (3) providing a mechanical sliding sleeve that exhibits a slimmer annular profile than conventional sliding sleeves; (4) providing a mechanical sliding sleeve that incorporates integral lubrication; (5) providing a mechanical sliding sleeve having a sealing element that regenerates its seal; (6) providing a mechanical sliding sleeve that is less likely to inadvertently shift between open and closed positions; and (7) providing a mechanical sliding sleeve that is easier to locate with actuation tools than conventional, mechanical sliding sleeves.

Additional features and advantages will be apparent in the written description which follows.

BRIEF DESCRIPTION OF THE DRAWINGS

The novel features characteristic of the invention are set forth in the appended claims. However, the invention itself, as well as a preferred mode of use, and further objectives and advantages thereof, will best be understood by reference to the following detailed description when read in conjunction with the accompanying drawings, in which the leftmost significant digit(s) in the reference numerals denote the first figure in which the respective reference numerals appear, wherein:

Figure 1:
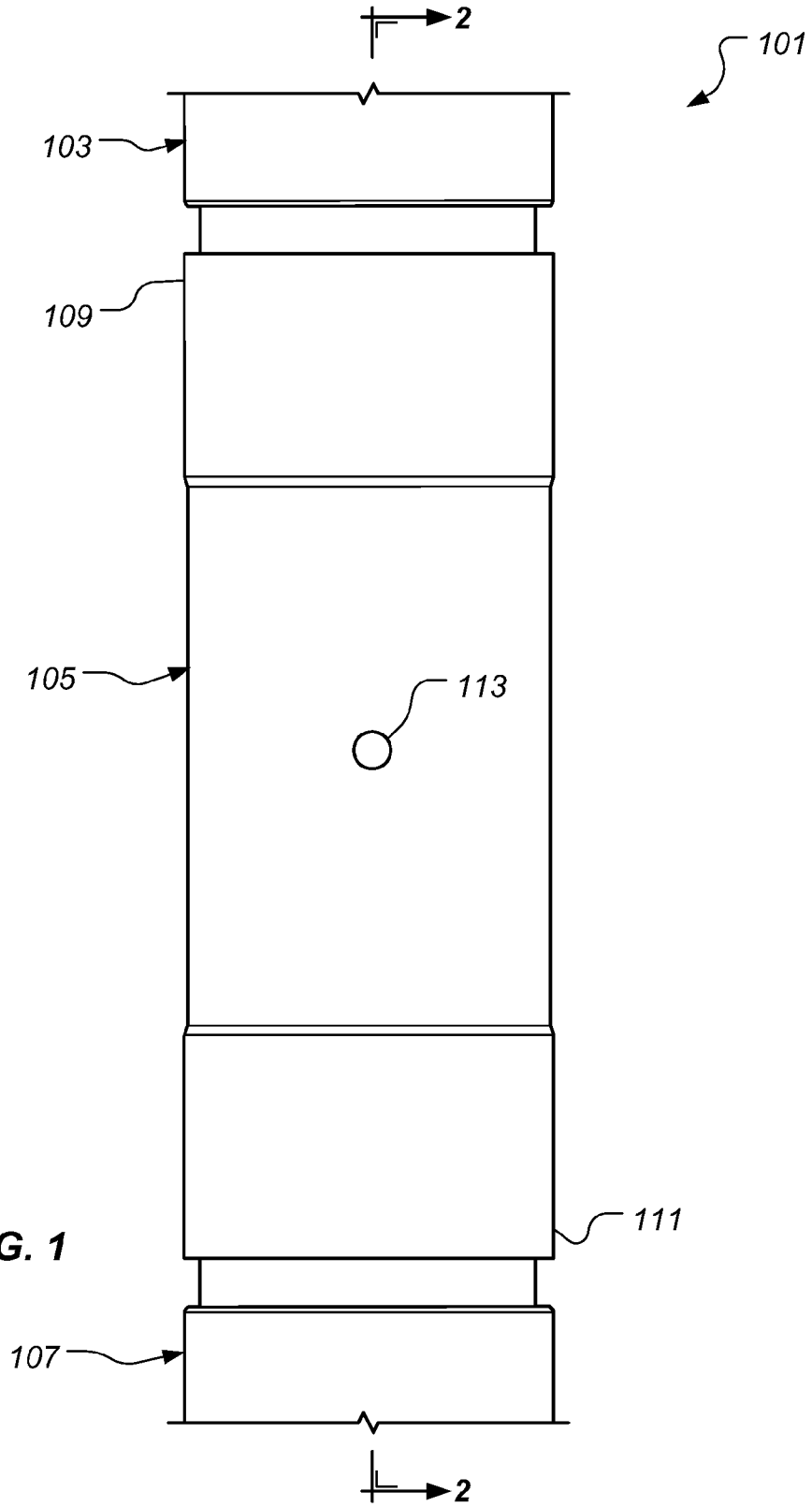
FIG. 1 is a side, elevational view of a first illustrative embodiment of a self-contained, mechanical sliding sleeve, shown in a closed configuration.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents a self-contained, mechanical sliding sleeve for use in downhole, oilfield operations. A shifting mechanism of the mechanical sliding sleeve is disposed in a sealed volume to inhibit debris in downhole fluid from interfering with the operation of the mechanical sliding sleeve.

Figure 2:
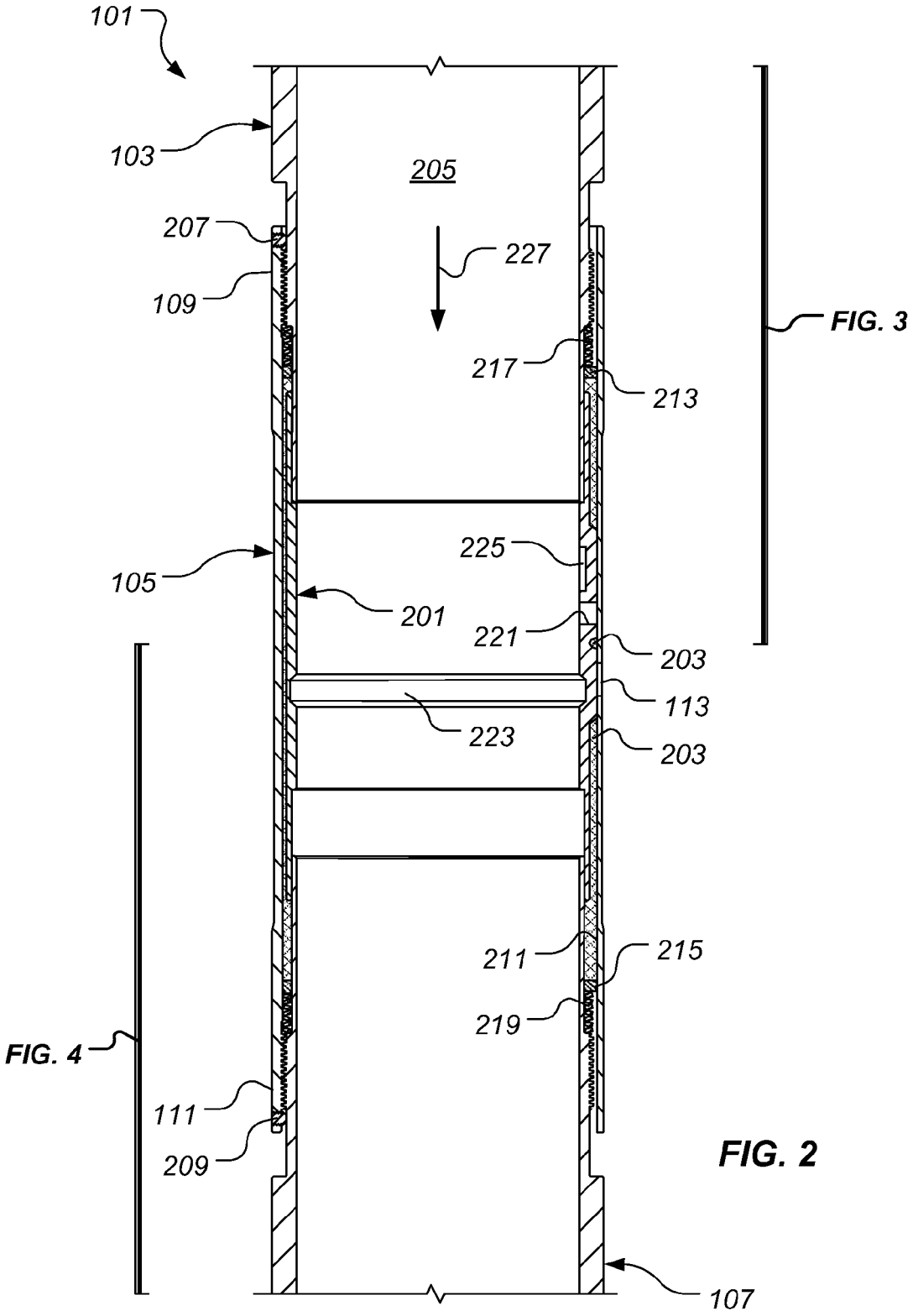
FIG. 2 is a cross-sectional view of the mechanical sliding sleeve of FIG. 1, taken along line 2-2 in FIG. 1.
Figure 3:
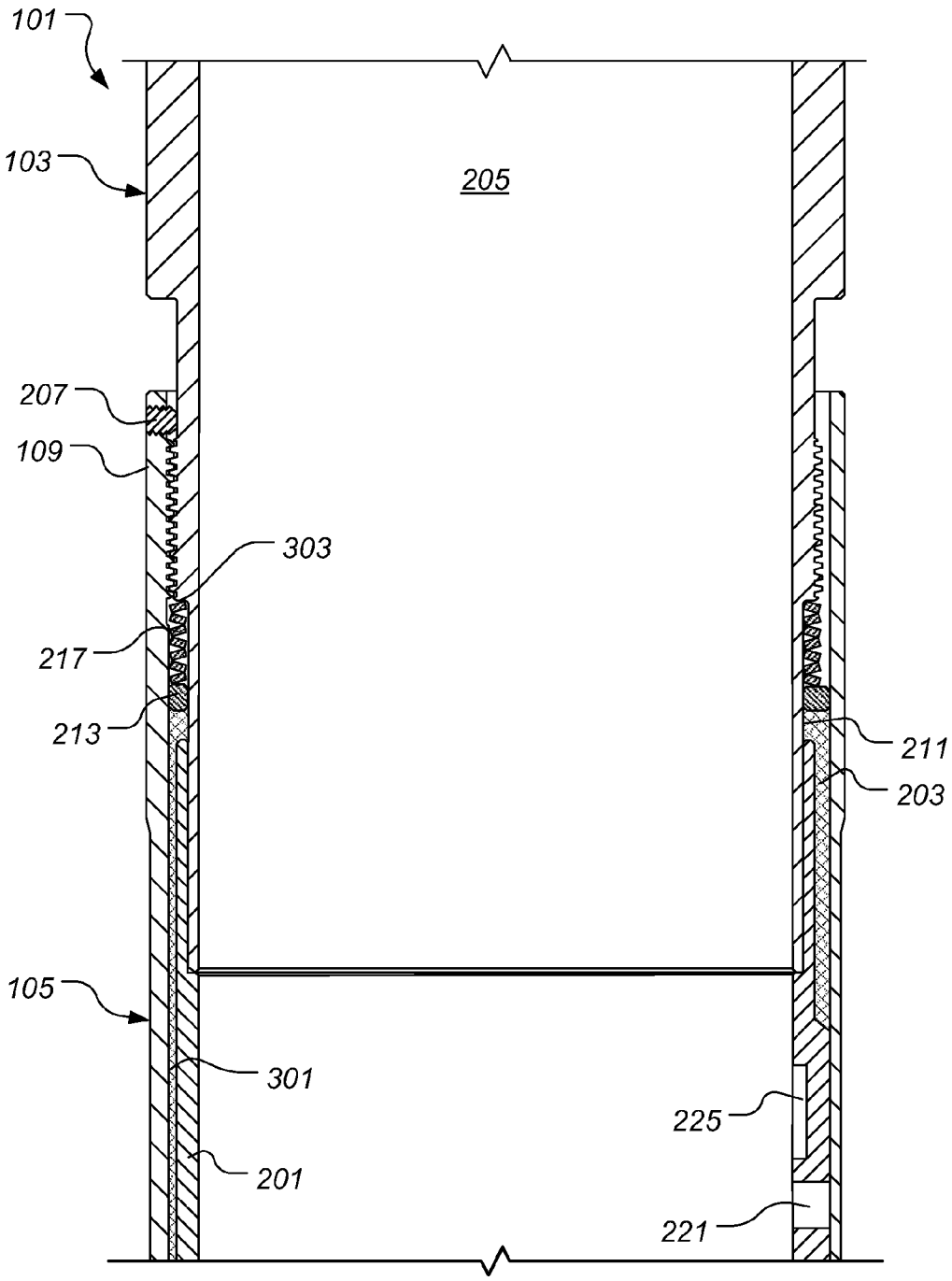
FIGS. 3 and 4 are enlarged, cross-sectional views of portions of the mechanical sliding sleeve of FIG. 1, as indicated in FIG. 2.
Figure 4:
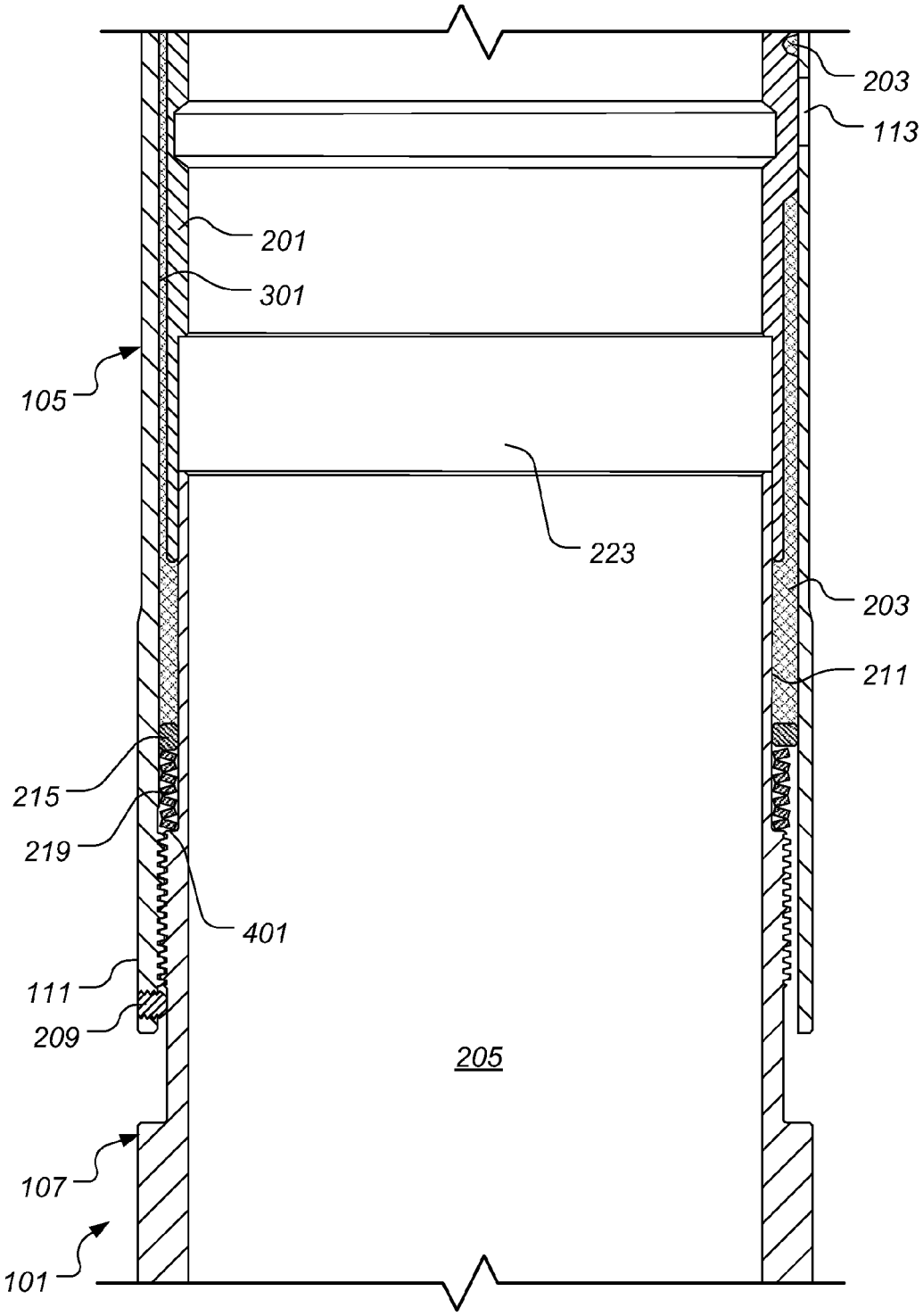
Figure 5:
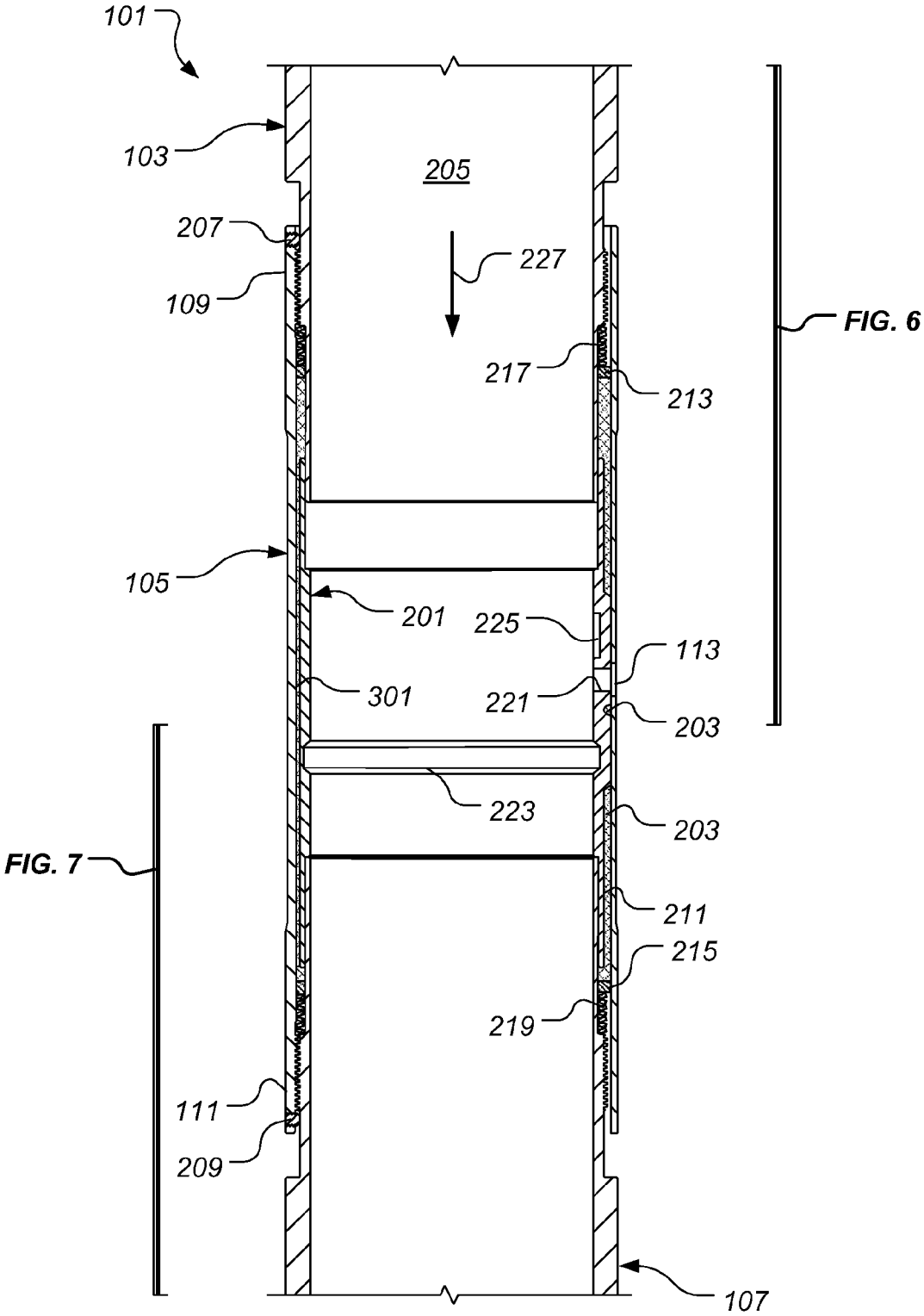
FIG. 5 is a cross-sectional view of the mechanical sliding sleeve of FIG. 1 corresponding to the view of FIG. 2, depicting the mechanical sliding sleeve in an open configuration.
Figure 6:
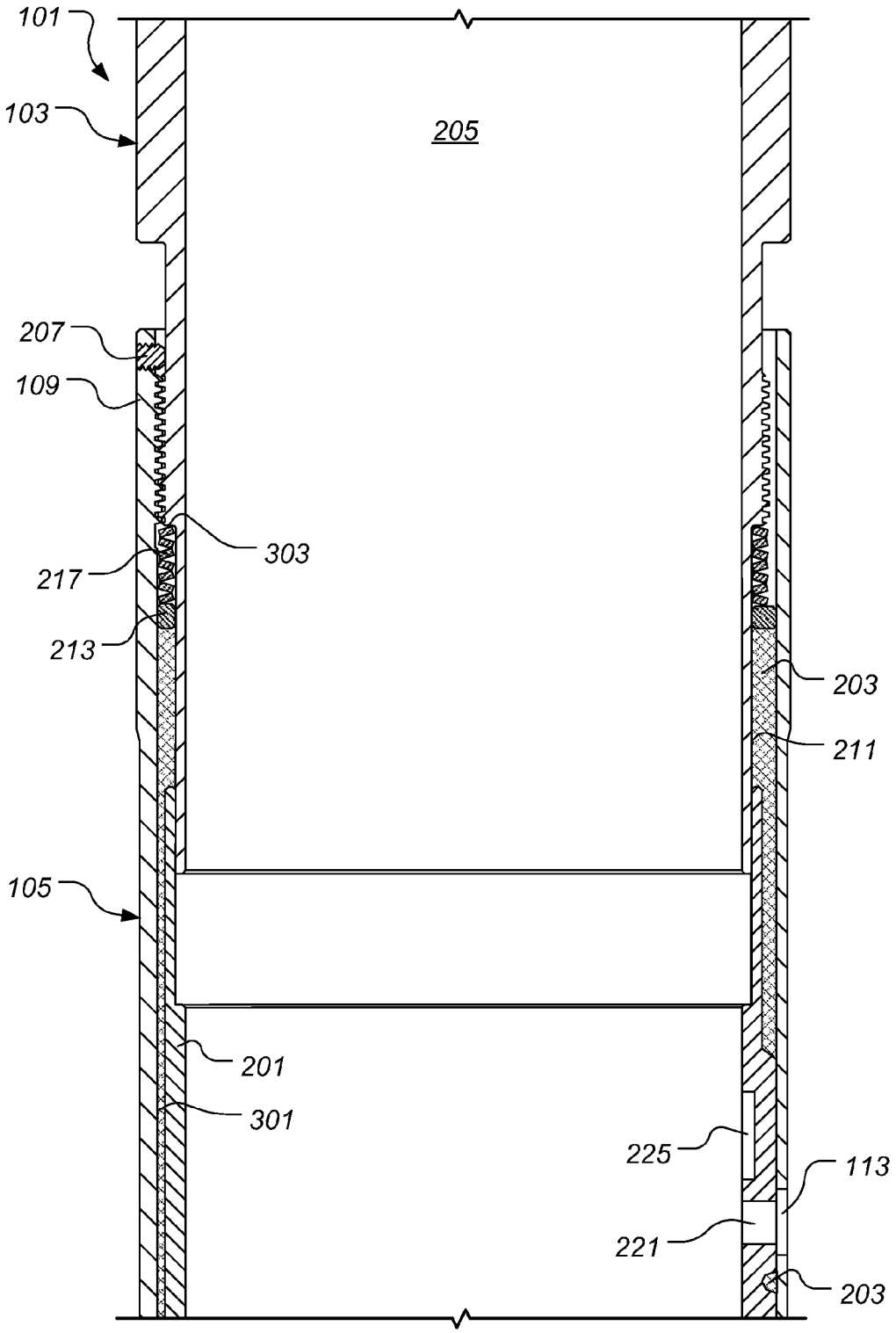
FIGS. 6 and 7 are enlarged, cross-sectional views of portions of the mechanical sliding sleeve of FIG. 1, as indicated in FIG. 5, depicting the mechanical sliding sleeve in an open configuration.
Figure 7:
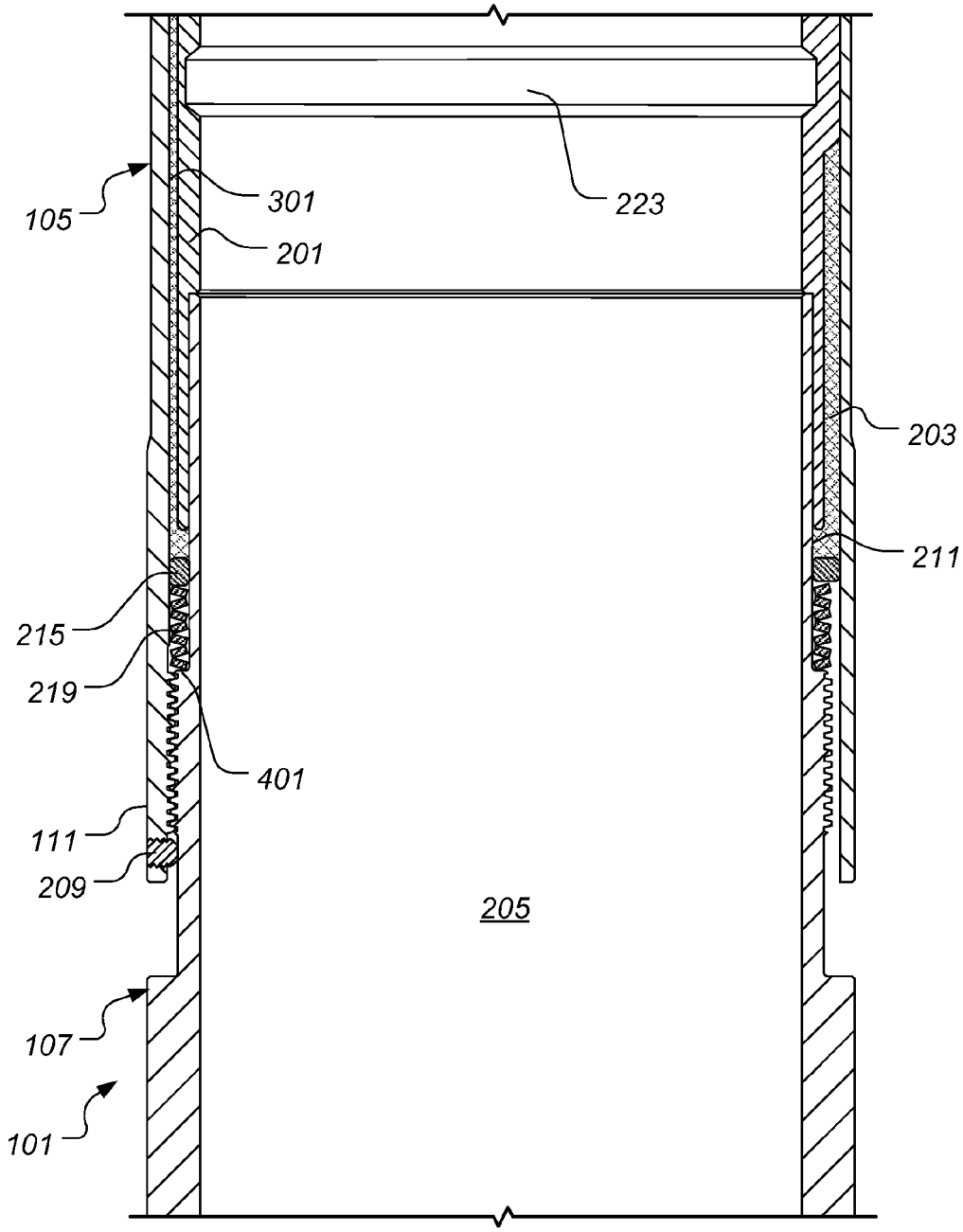

FIGS. 1-7 depict a first illustrative embodiment of a self-contained, mechanical sliding sleeve 101. In particular, FIG. 1 depicts a side, elevational view of mechanical sliding sleeve 101 in a "closed" configuration. FIG. 2 depicts a cross-sectional view of mechanical sliding sleeve 101, taken along line 2-2 in FIG. 1. FIGS. 3 and 4 depict enlarged, cross-sectional views of mechanical sliding sleeve 101, as indicated in FIG. 2. FIG. 5 depicts a cross-sectional view of mechanical sliding sleeve 101, also taken along line 2-2 in FIG. 1, showing mechanical sliding sleeve 101 in an "open" configuration. FIGS. 6 and 7 depict enlarged, cross-sectional views of mechanical sliding sleeve 101, as indicated in FIG. 5.

Referring to FIGS. 1-7, mechanical sliding sleeve 101 comprises a first sub 103, a sleeve housing 105, a second sub 107, an isolation sleeve 201, and one or more sealing elements, such as injectable packing 203. Isolation sleeve 201 is disposed within a bore 301 of sleeve housing 105. Isolation sleeve 201 is slidable with respect to sleeve housing 105 at least between a "closed" position (shown in FIGS. 1-4) and an "open" position (shown in FIGS. 5-7) to selectively allow fluid communication between a production bore 205 of mechanical sliding sleeve 101 and an annulus, such as an annulus 1501 (shown in FIG. 15) defined by mechanical sliding sleeve 101 and a well casing 1503 (shown in FIG. 15). First sub 103 is affixed to a first end 109 of sleeve housing 105 and second sub 107 is affixed to a second end 111 of sleeve housing 105. In the illustrated embodiment, first sub 103 is threadedly engaged with first end 109 of sleeve housing 105 and second sub 107 is threadedly engaged with second end 111 of sleeve housing 105. Set screws 207 and 209 are provided in the illustrated embodiment to inhibit first sub 103 and second sub 107, respectively, from becoming loosened or detached from sleeve housing 105.

First sub 103, sleeve housing 105, second sub 107, isolation sleeve 201, a first ring 213, and a second ring 215 define a volume 211 in which injectable packing 203 is disposed. First ring 213 is biased away from a shoulder 303 of first sub 103 by one or more first biasing elements 217 and second ring 215 is biased away from a shoulder 401 of second sub 107 by one or more second biasing elements 219. Accordingly, the one or more biasing elements 217 and 219 energize injectable packing 203. In the illustrated embodiment, the one or more biasing elements 217 and 219 include a plurality of spring or "Belleville" washers. Injectable packing 203 inhibits fluid communication between production bore 205 and an annulus, e.g., annulus 1501 (shown in FIG. 15), via volume 211 defined by first sub 103, sleeve housing 105, second sub 107, and isolation sleeve 201. Moreover, injectable packing 203 inhibits downhole fluids from contacting at least a portion of the siding surfaces of mechanical sliding sleeve 101, i.e., between isolation sleeve 201 and first sub 103, sleeve housing 105, and second sub 107. Thus, injectable packing 203 inhibits debris, such as debris found in downhole fluids, from collecting on at least a portion of the sliding surfaces of mechanical sliding sleeve 101.

Examples of materials for injectable packing 203 include, for example, Steam Shield 2000 available from Sealweld Corporation of Calgary, Alberta, Canada, which is a synthetic blend of fiber-reinforced polymer strands and lubricant. Embodiments that include injectable packing, such as injectable packing 203, generally exhibit smaller annular profiles than embodiments utilizing other types of sealing elements. Moreover, injectable packing 203 provides lubrication to decrease friction between isolation sleeve 201, first sub 103, sleeve housing 105, and second sub 107 when isolation sleeve 201 is slidingly operated between open and closed positions. Furthermore, because injectable packing 203 is contained within volume 211, injectable packing 203 is displaced within volume 211 when isolation sleeve 201 is shifted between open and closed positions. This displacement causes injectable packing 203 to flow between ends of isolation sleeve 201. Often, injectable packing 203 regenerates its seal after every shifting operation because injectable packing 203 is forced to flow in areas wherein the seal has been lost or where a void has formed. Additionally, injectable packing 203 can be formulated to endure more severe, e.g., higher temperature, higher pressure, more corrosive, and/or steam-containing, environments than other types of seals. The force required to shift isolation sleeve 201 through injectable packing 203 can also be taken advantage of to inhibit isolation sleeve 201 from inadvertently sliding to an undesired position.

Still referring to FIGS. 1-7, sleeve housing 105 defines a fluid communication port 113 and isolation sleeve 201 defines a fluid communication port 221. When mechanical sliding sleeve 101 is in the closed configuration, shown in FIGS. 1-4, isolation sleeve 201 is positioned such that fluid communication port 221 of isolation sleeve 201 is offset from, i.e., misaligned with respect to, fluid communication port 113 of sleeve housing 105. Thus, when mechanical sliding sleeve 101 is in the closed configuration, fluid communication is inhibited between production bore 205 and an annulus, e.g., annulus 1501 (shown in FIG. 15), via fluid communication ports 113 and 221. When mechanical sliding sleeve 101 is in the open configuration, shown in FIGS. 5-7, isolation sleeve 201 is positioned such that fluid communication port 221 of isolation sleeve 201 is at least generally aligned with fluid communication port 113 of sleeve housing 105. Thus, when mechanical sliding sleeve 101 is in the open configuration, fluid communication is allowed between production bore 205 and an annulus, e.g., annulus 1501 (shown in FIG. 15), via fluid communication ports 113 and 221.

Referring in particular to FIGS. 2-7, isolation sleeve 201 defines a locator groove 223 and a shifting slot 225. To slide isolation sleeve 201 between the closed position (shown in FIGS. 1-4) and the open position (shown in FIGS. 5-7), a tool (not shown) is run into production bore 205 of mechanical sliding sleeve 101. The tool is located with respect to isolation sleeve 201 by mating with locator groove 223. A feature of the tool engages shifting slot 225 of isolation sleeve 201. The tool is moved generally in a direction corresponding to an arrow 227 (shown in FIGS. 2 and 5) to slide isolation sleeve 201 from the closed position (shown in FIGS. 1-4) to the open position (shown in FIGS. 5-7). The tool is moved generally in a direction counter to arrow 227 to slide isolation sleeve 201 from the open position to the closed position.

Figure 8:
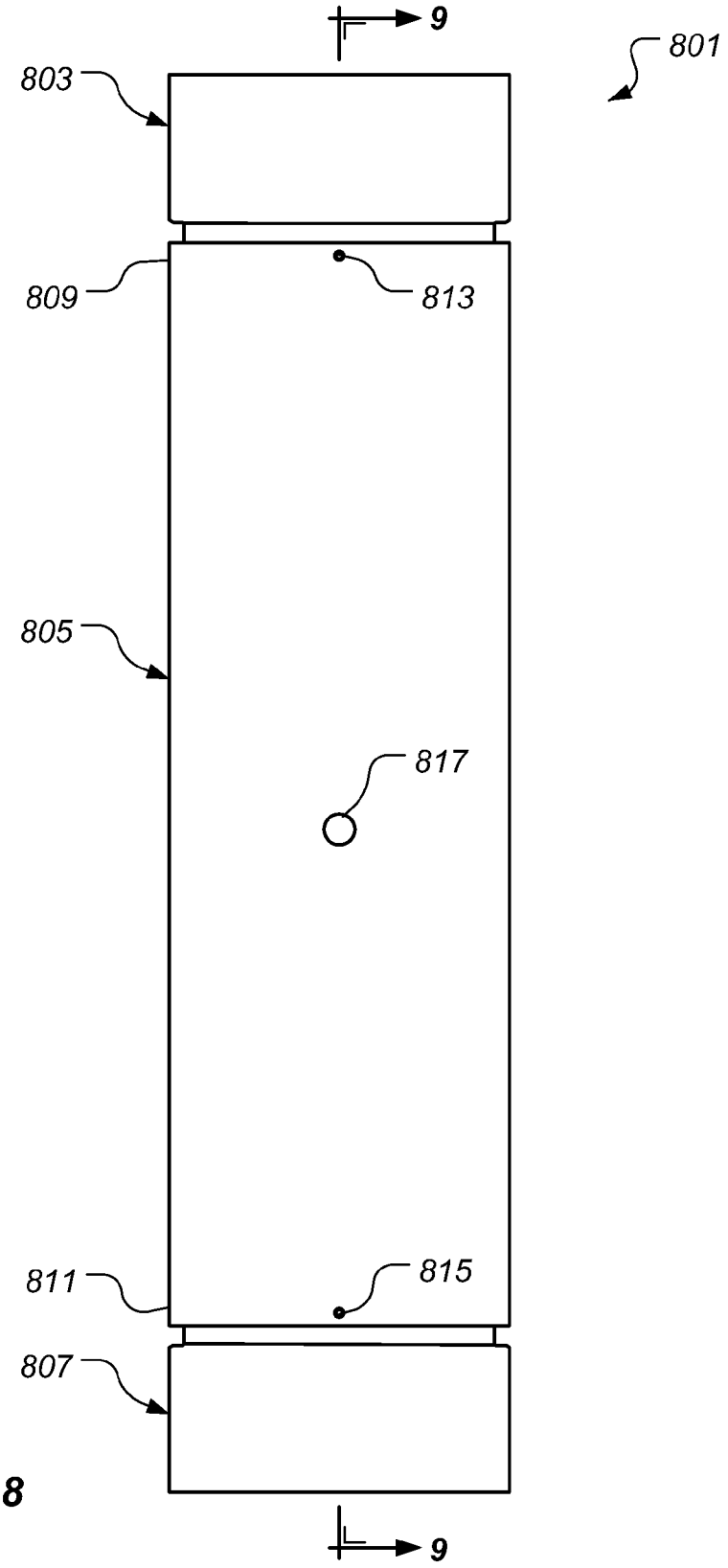
FIG. 8 is a side, elevational view of a second illustrative embodiment of a self-contained, mechanical sliding sleeve, shown in a closed configuration.
Figure 9:
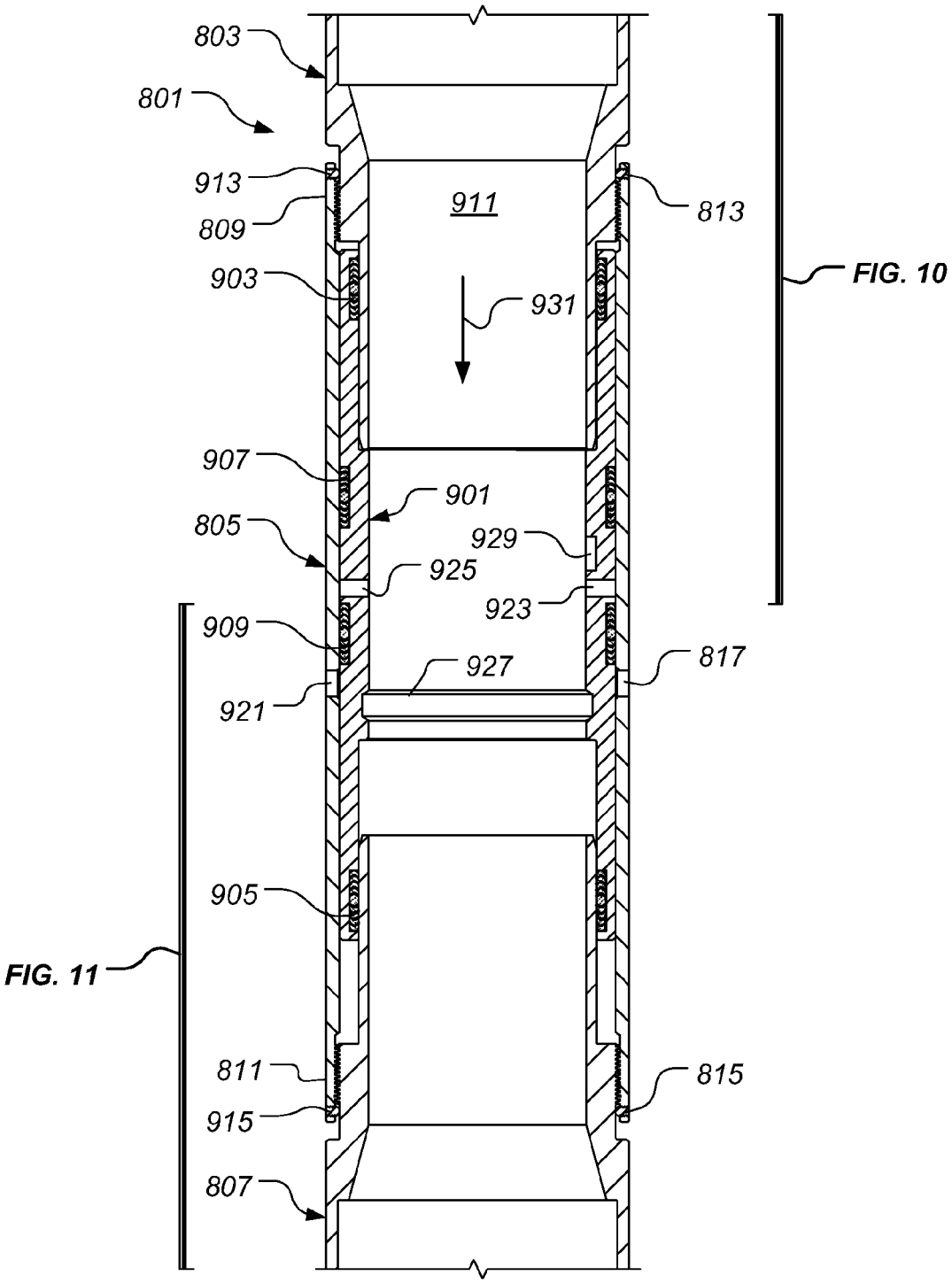
FIG. 9 is a cross-sectional view of the mechanical sliding sleeve of FIG. 8, taken along line 9-9 in FIG. 8.
Figure 10:
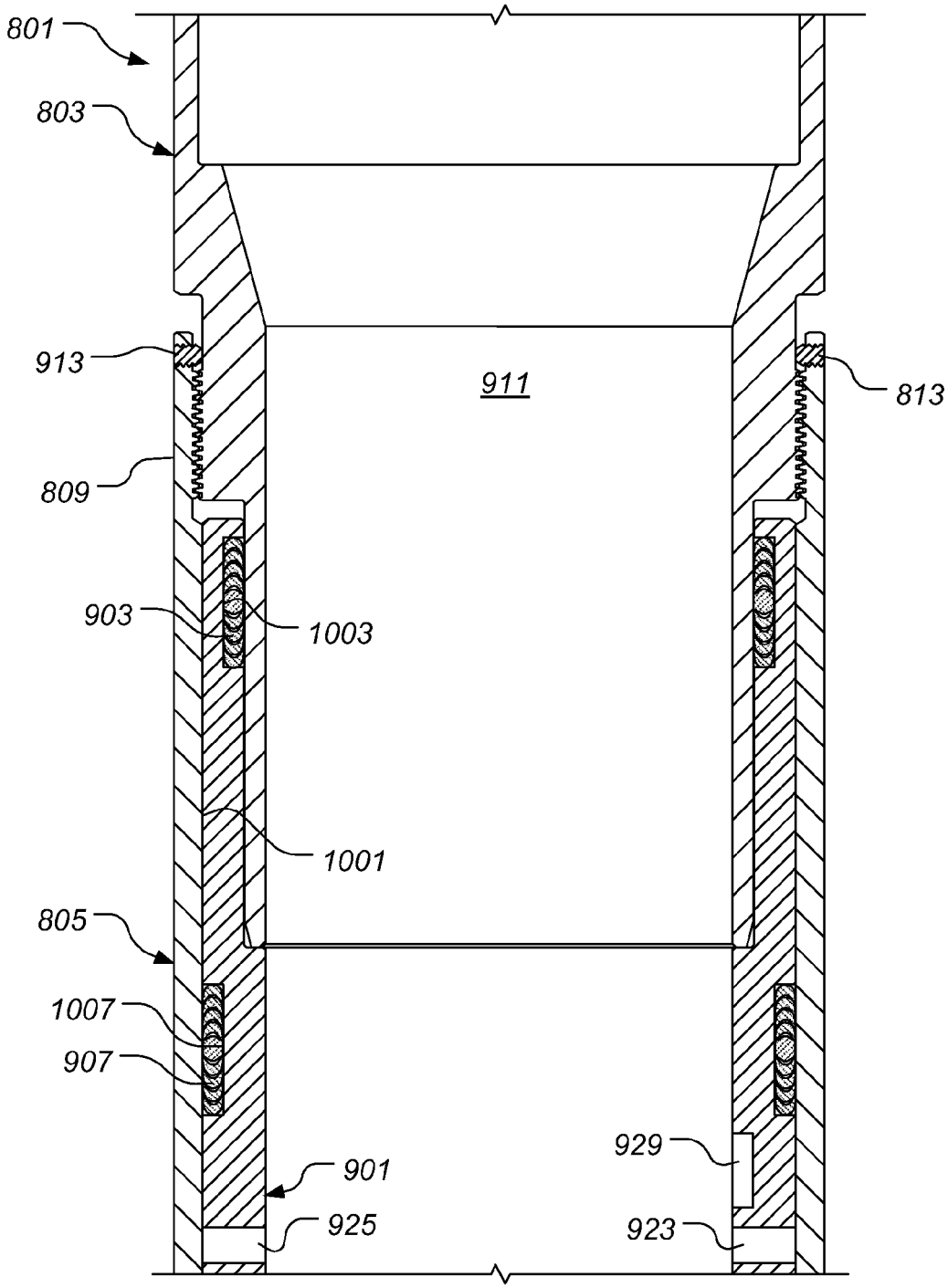
FIGS. 10 and 11 are enlarged, cross-sectional views of portions of the mechanical sliding sleeve of FIG. 8, as indicated in FIG. 9.
Figure 11:
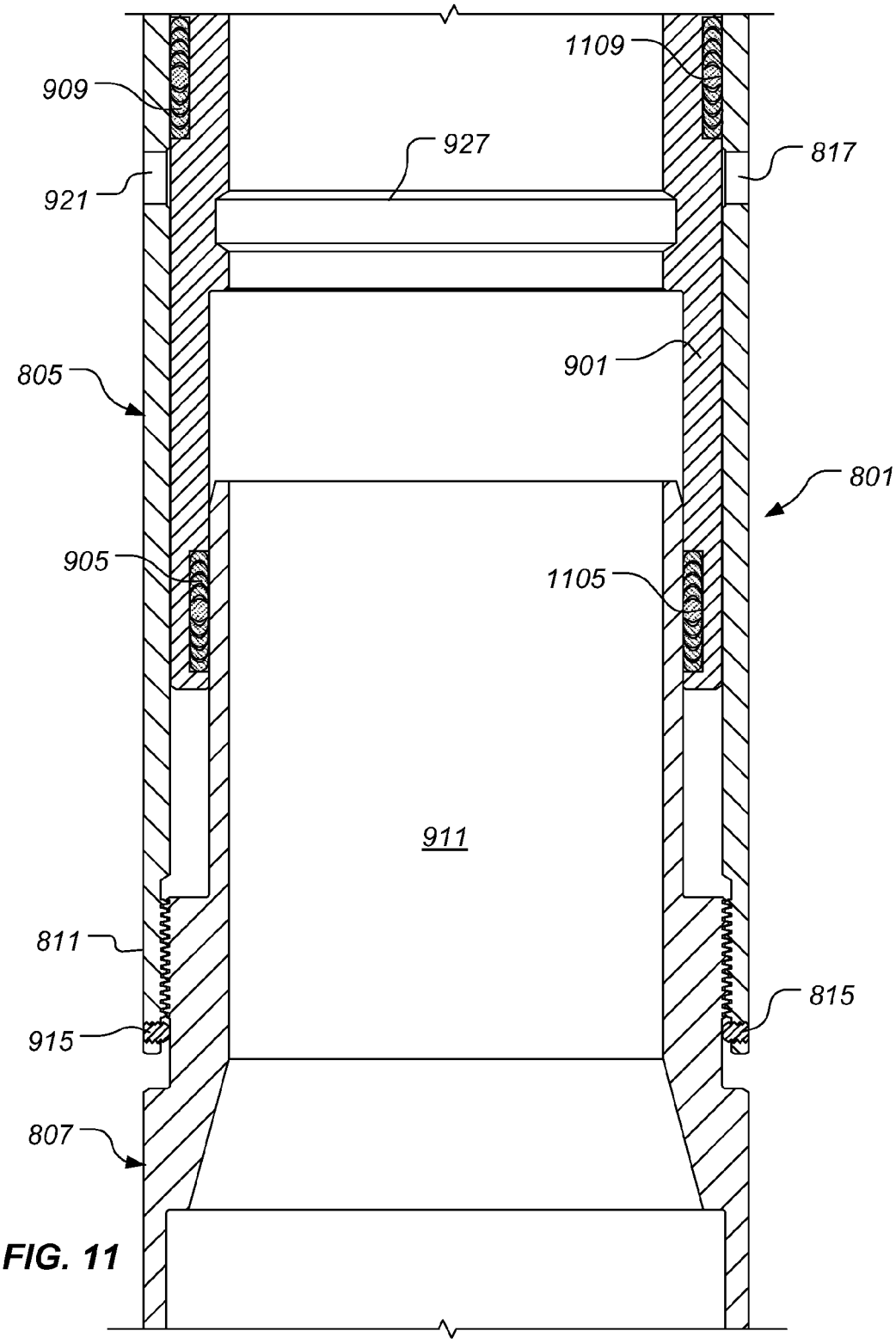
Figure 12:
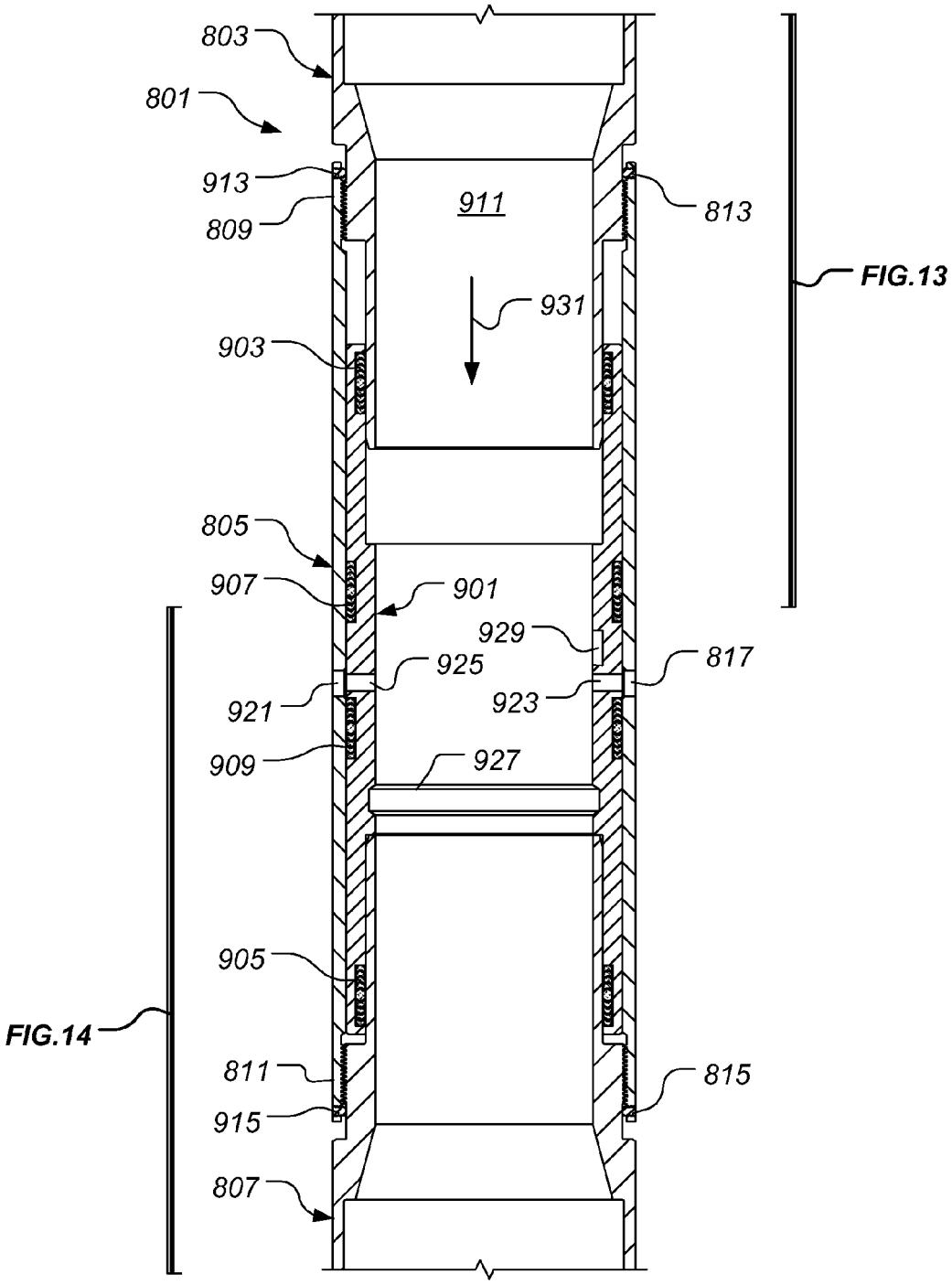
FIG. 12 is a cross-sectional view of the mechanical sliding sleeve of FIG. 8 corresponding to the view of FIG. 9, depicting the mechanical sliding sleeve in an open configuration.
Figure 13:
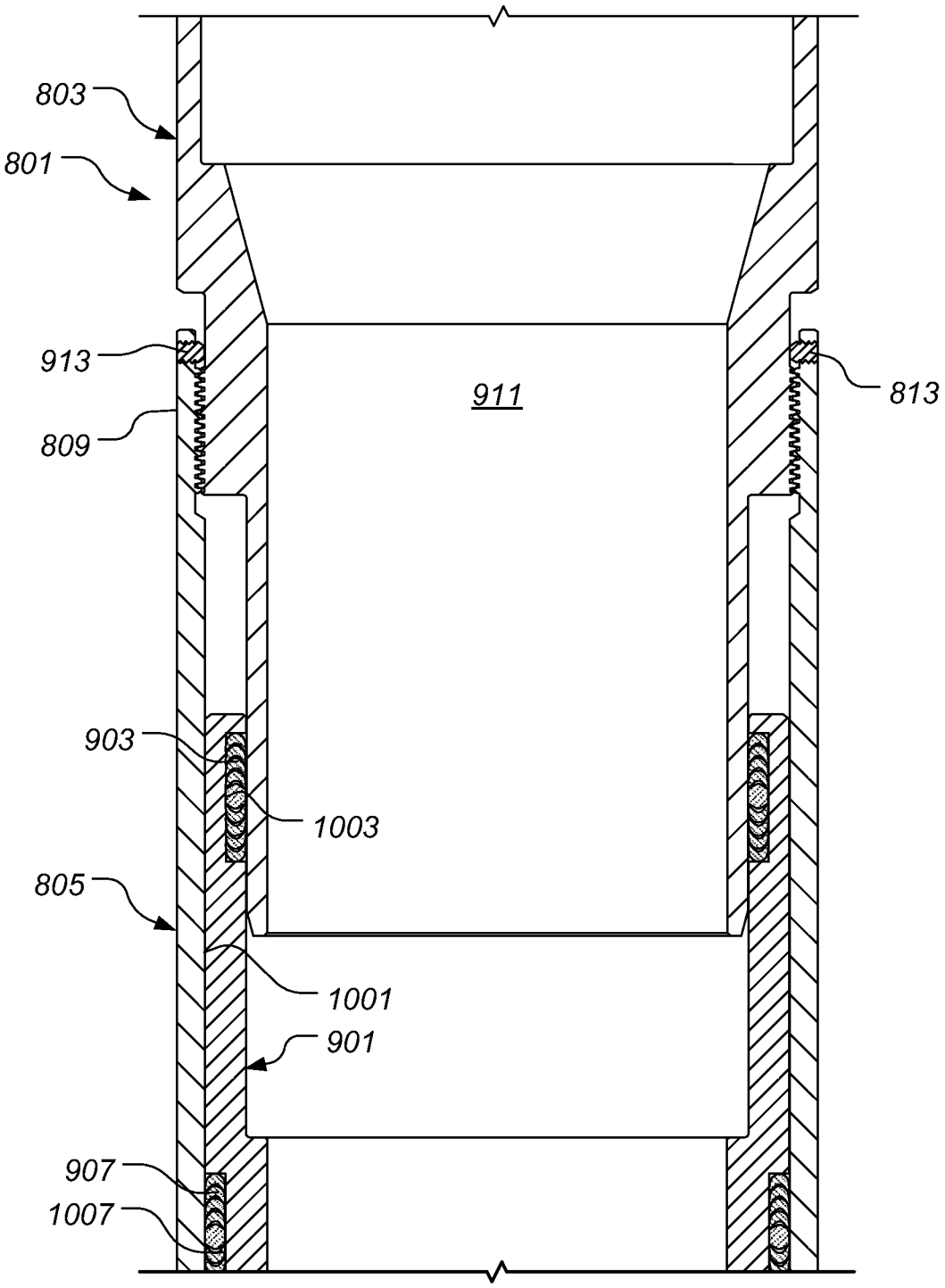
FIGS. 13 and 14 are enlarged, cross-sectional views of portions of the mechanical sliding sleeve of FIG. 8, as indicated in FIG. 12, depicting the mechanical sliding sleeve in an open configuration.
Figure 14:
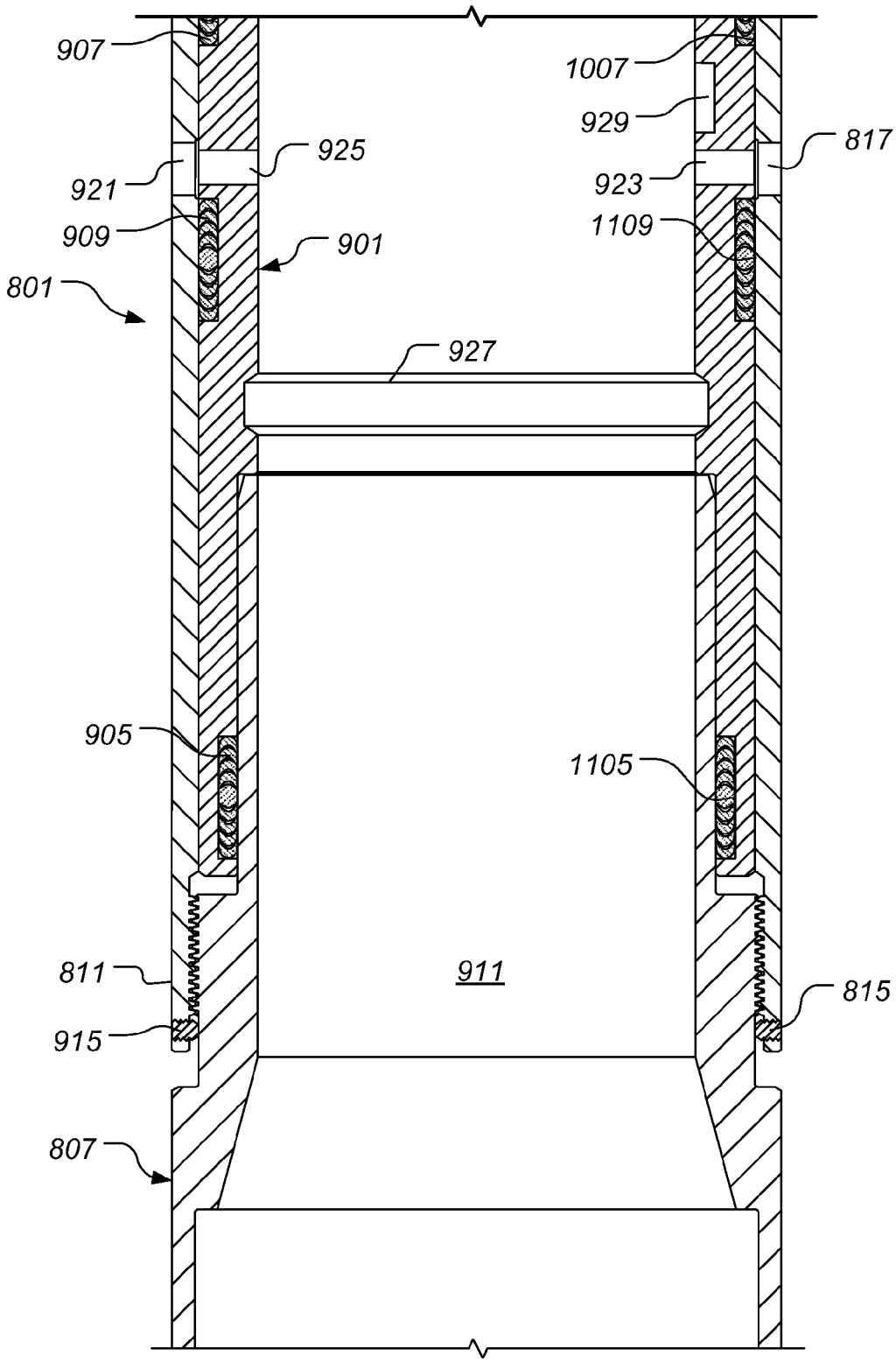

The present invention contemplates sliding mechanical seal embodiments that use sealing means other than injectable packing 203, such as, for example, pressure integral seals. Accordingly, FIGS. 8-14 depict a second illustrative embodiment of a self-contained, mechanical sliding sleeve 801. In particular, FIG. 8 depicts a side, elevational view of mechanical sliding sleeve 801 in a "closed" configuration. FIG. 9 depicts a cross-sectional view of mechanical sliding sleeve 801, taken along line 9-9 in FIG. 8. FIGS. 10 and 11 depict enlarged, cross-sectional views of mechanical sliding sleeve 801, as indicated in FIG. 9. FIG. 12 depicts a cross-sectional view of mechanical sliding sleeve 801, also taken along line 9-9 in FIG. 8, showing mechanical sliding sleeve 801 in an "open" configuration. FIGS. 13 and 14 depict enlarged, cross-sectional views of mechanical sliding sleeve 801, as indicated in FIG. 12.

Referring to FIGS. 8-14, mechanical sliding sleeve 801 comprises a first sub 803, a sleeve housing 805, a second sub 807, an isolation sleeve 901, and one or more sealing elements, such as pressure integral seals 903, 905, 907, and 909. Isolation sleeve 901 is disposed within a bore 1001 of sleeve housing 805. Isolation sleeve 901 is slidable with respect to sleeve housing 805 at least between a "closed" position (shown in FIGS. 8-11) and an "open" position (shown in FIGS. 12-14) to selectively allow fluid communication between a production bore 911 of mechanical sliding sleeve 801 and an annulus, such as an annulus 1501 (shown in FIG. 15) defined by mechanical sliding sleeve 801 and a well casing 1503 (shown in FIG. 15). First sub 803 is affixed to a first end 809 of sleeve housing 805 and second sub 807 is affixed to a second end 811 of sleeve housing 805. In the illustrated embodiment, first sub 803 is threadedly engaged with first end 809 of sleeve housing 805 and second sub 807 is threadedly engaged with second end 811 of sleeve housing 805. Set screws 813 and 913 are provided in the illustrated embodiment to inhibit first sub 803 from becoming loosened or detached from sleeve housing 805. Set screws 815 and 915 are provided in the illustrated embodiment to inhibit second sub 807 from becoming loosened or detached from sleeve housing 805.

In the illustrated embodiment, fluid communication between first sub 803 and isolation sleeve 901 is inhibited by pressure integral seal 903, disposed in a groove 1003 defined by isolation sleeve 901. Similarly, fluid communication between second sub 807 and isolation sleeve 901 is inhibited by pressure integral seal 905, disposed in a groove 1105 defined by isolation sleeve 901. Fluid communication between sleeve housing 805 and isolation sleeve 901 is inhibited by pressure integral seals 907 and 909, which are disposed in grooves 1007 and 1109, respectively, each defined by isolation sleeve 901. In the alternative, however, groove 1003 may be defined by first sub 803, groove 1105 may be defined by second sub 807, and grooves 1007 and 1109 may be defined by sleeve housing 805. Pressure integral seals 903, 905, 907, and 909 inhibit fluid communication between production bore 911 and an annulus, e.g., annulus 1501 (shown in FIG. 15) via interfaces between isolation sleeve 901 and first sub 803, sleeve housing 805, and second sub 807. Moreover, pressure integral seals 903, 905, 907, and 909 inhibit downhole fluids from contacting at least a portion of the siding surfaces of mechanical sliding sleeve 801, i.e., between isolation sleeve 901 and first sub 803, sleeve housing 805, and second sub 807, by sealing a volume about the sliding surfaces. Thus, pressure integral seals 903, 905, 907, and 909 inhibit debris, such as debris found in downhole fluids, from collecting on at least a portion of the sliding surfaces of mechanical sliding sleeve 801. It should be noted that many varieties of seals may be used as pressure integral seals 903, 905, 907, and 909. For example, pressure integral seals 903, 905, 907, and 909 may include chevron seals, o-rings, molded seals, or the like.

Still referring to FIGS. 8-14, sleeve housing 805 defines fluid communication ports 817 and 921, while isolation sleeve 901 defines fluid communication ports 923 and 925. When mechanical sliding sleeve 801 is in the closed configuration, shown in FIGS. 8-11, isolation sleeve 901 is positioned such that fluid communication ports 923 and 925 of isolation sleeve 901 are offset from, i.e., misaligned with respect to, fluid communication ports 817 and 921 of sleeve housing 805. Thus, when mechanical sliding sleeve 801 is in the closed configuration, fluid communication is inhibited between production bore 911 of mechanical sliding sleeve 801 and an annulus, e.g., annulus 1501 (shown in FIG. 15), via fluid communication ports 817, 921, 923, and 925. When mechanical sliding sleeve 801 is in the open configuration, shown in FIGS. 12-14, isolation sleeve 901 is positioned such that fluid communication ports 923 and 925 of isolation sleeve 901 are at least generally aligned with fluid communication ports 817 and 921 of sleeve housing 805. Thus, when mechanical sliding sleeve 801 is in the open configuration, fluid communication is allowed between production bore 911 and an annulus, e.g., annulus 1501 (shown in FIG. 15), via fluid communication ports 817, 921, 923, and 925.

Referring in particular to FIGS. 9-14, isolation sleeve 901 defines a locator groove 927 and a shifting slot 929. To slide isolation sleeve 901 between the closed position (shown in FIGS. 8-11) and the open position (shown in FIGS. 12-14), a tool (not shown) is run into production bore 911 of mechanical sliding sleeve 801. The tool is located with respect to isolation sleeve 901 by mating with locator groove 927. A feature of the tool engages shifting slot 929 of isolation sleeve 901. The tool is moved generally in a direction corresponding to an arrow 931 (shown in FIGS. 9 and 12) to slide isolation sleeve 901 from the closed position (shown in FIGS. 8-11) to the open position (shown in FIGS. 12-14). The tool is moved generally in a direction counter to arrow 931 to slide isolation sleeve 901 from the open position to the closed position.

Figure 15:
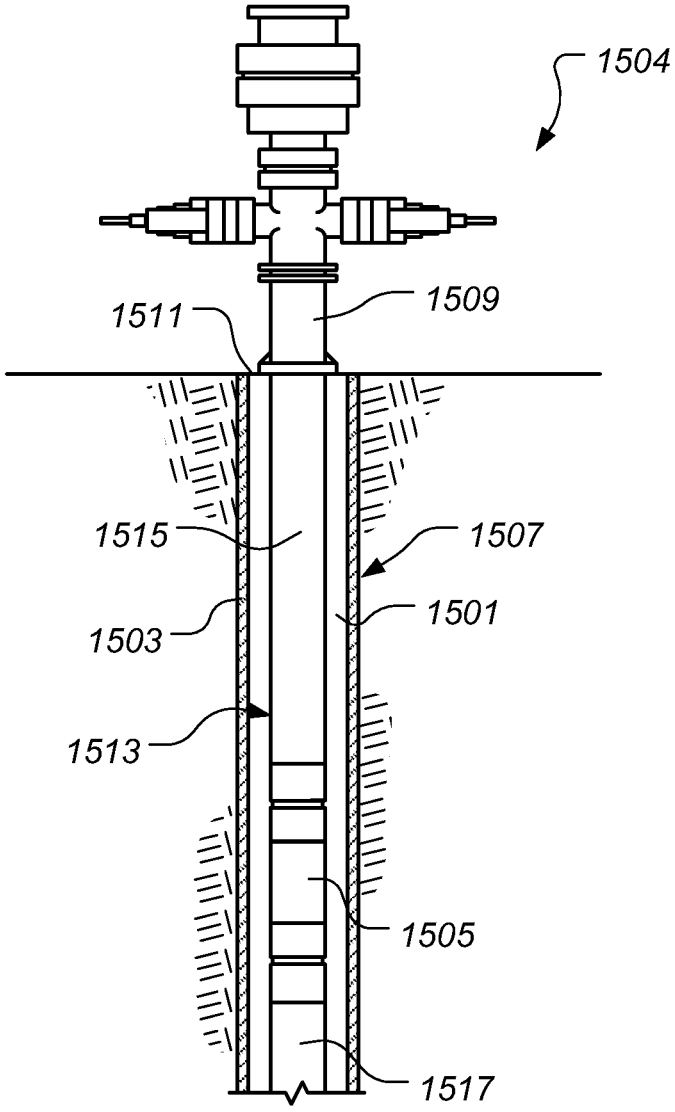
FIG. 15 is a stylized, partial cross-sectional view of an exemplary implementation of a mechanical sliding sleeve, such as the mechanical sliding sleeve embodiments of FIGS. 1-14.

FIG. 15 is a stylized, partial cross-sectional view of an exemplary well completion 1504 including a mechanical sliding sleeve 1505, such as mechanical sliding sleeve 101 or 801. In the illustrated embodiment, mechanical sliding sleeve 1505 is disposed in a well 1507 with a wellhead 1509 positioned at a surface 1511 of well 1507. Well casing 1503 extends from surface 1511 to a position proximate a lower end of well 1507. A production string 1513 extends from wellhead 1509 into well 1507 via well casing 1503. Mechanical sliding sleeve 1505 is disposed between an upper portion 1515 of production string 1513 and a lower portion 1517 of production string 1513. When in the open configuration, fluid communication is allowed between an interior of production string 1513 and annulus 1501, while when in the closed configuration, fluid communication is inhibited between an interior of production string 1513 and annulus 1501.

While mechanical sliding sleeve 1505 is depicted in a particular implementation in FIG. 15, the scope of the present invention is not so limited. Rather, it will be appreciated that mechanical sliding sleeve 1505 may be incorporated into production strings having configurations other than that shown in FIG. 15 or may be incorporated into completion or workover strings, with wellhead 1509 being removed and a workover or drilling apparatus being positioned relative to well 1507.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope of the invention. Accordingly, the protection sought herein is as set forth in the claims below. Although the present invention is shown in a limited number of forms, it is not limited to just these forms, but is amenable to various changes and modifications.

What is claimed is:

1. A mechanical sliding sleeve, comprising:

a sleeve housing defining a fluid communication port, a first end and a second end;

a first sub affixed to the first end of the sleeve housing;

a second sub affixed to the second end of the sleeve housing, such that the sleeve housing, the first sub, and the second sub define an internal bore;

an isolation sleeve disposed in the internal bore and defining a fluid communication port, the isolation sleeve being slidable along interfaces between the first sub, the second sub, and the sleeve housing between an open position wherein the fluid communication port of the isolation sleeve is at least generally aligned with the fluid communication port of the sleeve housing and a closed position wherein the fluid communication port of the isolation sleeve is misaligned with the fluid communication port of the sleeve housing; and at least one sealing element comprising injectable packing, the at least one sealing element operably associated with the sleeve housing, the first sub, the second sub, and the isolation sleeve, the at least one sealing element inhibiting fluid flow through the fluid communication ports unless the isolation sleeve is in the open position and sealing at least a portion of the interfaces from contact with downhole fluids.

2. The sliding sleeve of claim 1, wherein the first sub comprises a first shoulder and the second sub comprises a second shoulder, the sliding sleeve further comprising:

a first biasing element abutting the first shoulder;

a first ring disposed between and abutting the first biasing element and the injectable packing;

a second biasing element abutting the second shoulder; and a second ring disposed between and abutting the second biasing element and the injectable packing;

wherein the first sub, the sleeve housing, the second sub, the isolation sleeve, the first ring, and the second ring define a volume in which the injectable packing is disposed.

3. The sliding sleeve of claim 2, wherein the first biasing element and the second biasing element energize the injectable packing.

4. The sliding sleeve of claim 1, wherein the injectable packing comprises a synthetic blend of fiber-reinforced polymer strands and lubricant.

5. A mechanical sliding sleeve, comprising:

a sleeve housing defining a fluid communication port, a first end and a second end;

a first sub affixed to the first end of the sleeve housing;

a second sub affixed to the second end of the sleeve housing, such that the sleeve housing, the first sub, and the second sub define an internal bore;

an isolation sleeve disposed in the internal bore and defining a fluid communication port, the isolation sleeve being slidable along interfaces between the first sub, the second sub, and the sleeve housing between an open position wherein the fluid communication port of the isolation sleeve is at least generally aligned with the fluid communication port of the sleeve housing and a closed position wherein the fluid communication port of the isolation sleeve is misaligned with the fluid communication port of the sleeve housing; and at least one sealing element comprising a plurality of pressure integral seals, the at least one sealing element operably associated with the sleeve housing, the first sub, the second sub, and the isolation sleeve, the at least one sealing element inhibiting fluid flow through the fluid communication ports unless the isolation sleeve is in the open position and sealing at least a portion of the interfaces from contact with downhole fluids.

6. The sliding sleeve of claim 5, wherein the isolation sleeve comprises a plurality of grooves corresponding to the plurality of pressure integral seals, such that the plurality of pressure integral seals are disposed in the plurality of grooves.

7. The sliding sleeve of claim 5, wherein at least one of the plurality of pressure integral seals includes one of a chevron seal, an o-ring, and a molded seal.

8. The sliding sleeve of claim 1, wherein the isolation sleeve comprises a locator groove.

9. The sliding sleeve of claim 1, wherein the isolation sleeve comprises a shifting slot.

10. A tubing string, comprising:

a production string having an upper portion and a lower portion; and a mechanical sliding sleeve affixed between and in fluid communication with the upper portion of the production string and the lower portion of the production string, the sliding sleeve comprising:

a sleeve housing defining a fluid communication port, a first end and a second end;

a first sub affixed to the first end of the sleeve housing and to the upper portion of the production string;

a second sub affixed to the second end of the sleeve housing and to the lower portion of the production string, such that the sleeve housing, the first sub, and the second sub define an internal bore;

an isolation sleeve disposed in the internal bore and defining a fluid communication port, the isolation sleeve being slidable along interfaces between the first sub, the second sub, and the sleeve housing between an open position wherein the fluid communication port of the isolation sleeve is at least generally aligned with the fluid communication port of the sleeve housing and a closed position wherein the fluid communication port of the isolation sleeve is misaligned with the fluid communication port of the sleeve housing; and at least one sealing element comprising injectable packing, the at least one sealing element operably associated with the sleeve housing, the first sub, the second sub, and the isolation sleeve, the at least one sealing element inhibiting fluid flow through the fluid communication ports unless the isolation sleeve is in the open position and sealing at least a portion of the interfaces from contact with downhole fluids.

11. The tubing string of claim 10, wherein the first sub comprises a first shoulder and the second sub comprises a second shoulder, the sliding sleeve further comprising:

a first biasing element abutting the first shoulder;

a first ring disposed between and abutting the first biasing element and the injectable packing;

a second biasing element abutting the second shoulder; and a second ring disposed between and abutting the second biasing element and the injectable packing;

wherein the first sub, the sleeve housing, the second sub, the isolation sleeve, the first ring, and the second ring define a volume in which the injectable packing is disposed.

12. The tubing string of claim 11, wherein the first biasing element and the second biasing element energize the injectable packing.

13. The tubing string of claim 10, wherein the injectable packing comprises a synthetic blend of fiber-reinforced polymer strands and lubricant.

14. A tubing string, comprising:

a production string having an upper portion and a lower portion; and a mechanical sliding sleeve affixed between and in fluid communication with the upper portion of the production string and the lower portion of the production string, the sliding sleeve comprising:

a sleeve housing defining a fluid communication port, a first end and a second end;

a first sub affixed to the first end of the sleeve housing and to the upper portion of the production string;

a second sub affixed to the second end of the sleeve housing and to the lower portion of the production string, such that the sleeve housing, the first sub, and the second sub define an internal bore;

an isolation sleeve disposed in the internal bore and defining a fluid communication port, the isolation sleeve being slidable along interfaces between the first sub, the second sub, and the sleeve housing between an open position wherein the fluid communication port of the isolation sleeve is at least generally aligned with the fluid communication port of the sleeve housing and a closed position wherein the fluid communication port of the isolation sleeve is misaligned with the fluid communication port of the sleeve housing; and at least one sealing element comprising a plurality of pressure integral seals, wherein at least one of the plurality of pressure integral seals includes a molded seal, the at least one sealing element operably associated with the sleeve housing, the first sub, the second sub, and the isolation sleeve, the at least one sealing element inhibiting fluid flow through the fluid communication ports unless the isolation sleeve is in the open position and sealing at least a portion of the interfaces from contact with downhole fluids.

15. The tubing string of claim 14, wherein the isolation sleeve comprises a plurality of grooves corresponding to the plurality of pressure integral seals, such that the plurality of pressure integral seals are disposed in the plurality of grooves.

16. The tubing string of claim 10, wherein the isolation sleeve comprises a locator groove.

17. The tubing string of claim 10, wherein the isolation sleeve comprises a shifting slot.

18. A well completion, comprising:

a wellhead;

a production string having an upper portion affixed to the wellhead and a lower portion; and a mechanical sliding sleeve affixed between and in fluid communication with the upper portion of the production string and the lower portion of the production string, the sliding sleeve comprising:

a sleeve housing defining a fluid communication port, a first end and a second end;

a first sub affixed to the first end of the sleeve housing and to the upper portion of the production string;

a second sub affixed to the second end of the sleeve housing and to the lower portion of the production string, such that the sleeve housing, the first sub, and the second sub define an internal bore;

an isolation sleeve disposed in the internal bore and defining a fluid communication port, the isolation sleeve being slidable along interfaces between the first sub, the second sub, and the sleeve housing between an open position wherein the fluid communication port of the isolation sleeve is at least generally aligned with the fluid communication port of the sleeve housing and a closed position wherein the fluid communication port of the isolation sleeve is misaligned with the fluid communication port of the sleeve housing; and at least one sealing element comprising injectable packing, the at least one sealing element operably associated with the sleeve housing, the first sub, the second sub, and the isolation sleeve, the at least one sealing element inhibiting fluid flow through the fluid communication ports unless the isolation sleeve is in the open position and sealing at least a portion of the interfaces from contact with downhole fluids.

* * * * *